United States Patent [19]

Hoover

[11] Patent Number: 5,045,889

[45] Date of Patent: Sep. 3, 1991

[54] RELEASE LIQUID APPLYING WICK HAVING A GROOVED FEED TUBE

[75] Inventor: Linn C. Hoover, Rochester, N.Y.

[73] Assignee: Eastman Kodak Company, Rochester, N.Y.

[21] Appl. No.: 569,335

[22] Filed: Aug. 20, 1990

[51] Int. Cl.[5] ..... G03G 15/20

[52] U.S. Cl. ..... 355/284; 118/258

[58] Field of Search ..... 355/282, 284; 118/60, 118/256, 258, 260, 268; 219/216; 432/60; 222/187; 184/63, 64; 401/196–199

[56] References Cited

U.S. PATENT DOCUMENTS

| | | | |
|---|---|---|---|
| 2,563,048 | 8/1951 | Liebelt et al. | 401/197 |
| 2,563,049 | 8/1951 | Liebelt et al. | 401/197 |
| 2,565,743 | 8/1951 | Shaefer | 401/197 |
| 2,957,448 | 10/1960 | Dynia | 118/259 |
| 3,964,431 | 6/1976 | Namiki | 118/60 |
| 3,996,888 | 12/1976 | Lofdahl et al. | 118/70 |
| 4,375,201 | 3/1983 | Kato | 118/264 X |
| 4,429,990 | 2/1984 | Tamary | 355/284 |
| 4,757,347 | 7/1988 | Tamaoki et al. | 355/284 |
| 4,908,670 | 3/1990 | Ndebi | 355/284 |

FOREIGN PATENT DOCUMENTS

| | | | |
|---|---|---|---|
| 58/209770 | 12/1983 | Japan . | |
| 0215674 | 12/1983 | Japan | 355/284 |
| 0172063 | 9/1985 | Japan | 355/284 |
| 0073981 | 4/1986 | Japan | 355/284 |
| 61/245178 | 10/1986 | Japan . | |
| 0023382 | 1/1990 | Japan | 355/284 |

*Primary Examiner*—A. T. Grimley
*Assistant Examiner*—William J. Royer
*Attorney, Agent, or Firm*—Leonard W. Treash, Jr.

[57] ABSTRACT

A rotatable wick for a fuser or other fixing device includes a feed tube having distribution holes through which release liquid can be pumped. One or more grooves in the outer surface of the feed tube extend around the tube. The feed holes open into the groove. A thin porous sheath around the tube covers the groove while leaving an air space between the distribution holes and the sheath. A wicking material is wrapped around the outside of the sheath. The sheath protects the distribution holes from contact with the wicking material.

12 Claims, 2 Drawing Sheets

RELEASE LIQUID APPLYING WICK HAVING A GROOVED FEED TUBE

TECHNICAL FIELD

This invention relates to roller fixing of the type used in electrophotographic and electrographic copiers and printers. More specifically, this invention relates to a wicking structure for the application or release liquid to the surface of a roller in a fixing device.

BACKGROUND ART

U.S. Pat. No. 4,429,990granted to E. J. Tamary Feb. 7, 1984 discloses a wicking structure for applying release liquid to the surface of a roller in a roller fixing apparatus. Release liquid, commonly referred to as "oil", is transported under pressure from a container to a permanent internal feed tube located inside a replaceable porous applicating wick. The feed tube and wick constitute a wicking or application roller which, when in contact with the fixing roller, is rotated by it while it "oils" the surface. This structure has many advantages including ease in articulation, efficient and rapid application of oil in response to an appropriate signal and quite low wear on the fixing roller surface.

The structure shown in the Tamary patent is commonly called a "rotating wick" and has been adopted commercially in a number of copiers and printers. The release liquid is delivered to the wicking structure using a pump through a feed means to a permanent, rotatable feed tube. The feed tube is cylindrical and has small distribution holes drilled or punched along its cylindrical wall through which liquid can pass. A replaceable wick surrounds the feed tube. It is installed by being pulled over the free end of the feed tube. The replaceable wick is a porous structure which includes an inner ceramic porous material that is covered by a porous and heat resistant fabric such as wool or a comparable synthetic fabric. The most commonly used such fabric is marketed by Dupont under the trademark NOMEX and is a well-known capillary fabric which is resistant to heat.

The ceramic core creates an air gap between the feed tube and any capillary material including the ceramic core. With that air gap, there is no danger of contact between the wicking material and the holes in the feed tube. If the wicking material contacts the distribution holes, any oil that is left in the tube when the pressure is removed is subject to wicking by the capillary material to greatly oversaturate that portion of the wicking material. This would ultimately create localized areas of heavy wicking on the roller with disasterous results to an image being fixed. Thus, the ceramic material helps spread the oil evenly around and along the wick, provides structural strength to the replaceable portion of the wick and separates the wicking material from the distribution apertures in the tube.

Although these wicking structures have been successful commercially, maintenance is complicated by the cost associated with the replaceable portion of the wick and by occasional clogging of the holes in the feed tube which clogging is not necessarily cleared merely by replacing the wicking structure. By far the most expensive item in the replaceable portion of the wick is the ceramic core.

U.S. Pat. No. 4,908,670 granted Mar. 13, 1990 to S. L. Ndebi suggests a wick for a fusing roller which includes a disposable feed tube in which care is paid to the size and/or shape of apertures through which the liquid passes and a soft porous capillary material surrounding the tube itself. This structure improves the reliability of the overall rotating wick device because the tube itself is replaced with the rest of the wick. It also sunstantially reduces the cost of the wick by eliminating the ceramic core.

Although this structure has these advantages of increased reliability and reduced cost, it works best with high viscosity oil.

DISCLOSURE OF THE INVENTION

It is an object of the invention to provide a wicking structure similar to those described in both the Tamary and the Ndebi patents but which eliminates the expense of the ceramic core while obtaining good distribution of liquid around the core and reduced instances of oil oversaturation in localized portions of the wick.

These and other objects are accomplished by a wick which includes a feed tube having a plurality of distribution holes through which release liquid can flow under pressure. The feed tube includes groove means in its outer surface which extends around the tube and into which the distribution holes open. A thin porous sheath around the tube covers the groove means while leaving an air space between the opening of the distribution hole and the sheath. A wicking material is wrapped around the outside of the sheath.

With this structure the groove means helps distribute the oil around the wick and, with the sheath, also prevents the fibers of the wicking material from entering the distribution holes. This provides good distribution and reliability despite the the lack of a ceramic core.

Although a separate groove can be provided for each distribution hole, a preferred embodiment of the invention includes a single helical groove into which all distribution holes open. Since it is desirable to have the distribution holes positioned in a line parallel to the axis of the wick, the helical groove preferably has a lead equal to the distance between the distribution holes.

The porous sheath can be made of any of a number of materials which allow liquid to pass but restrict passage of wicking fibers, for example, a polyester, wool, or NOMEX cloth.

The wicking material can be any wicking material presently used for rotating wicks, for example, a NOMEX needle felt fabric. However, I have found that better results in many applications are obtained with a polytetrafluoroethylene (PTFW) needle felt covering for the entire fabric cover or for the outside layer of the fabric covering. In fact, I have found that a PTFE covering provides advantages in rotating wicks with or without the ceramic core.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
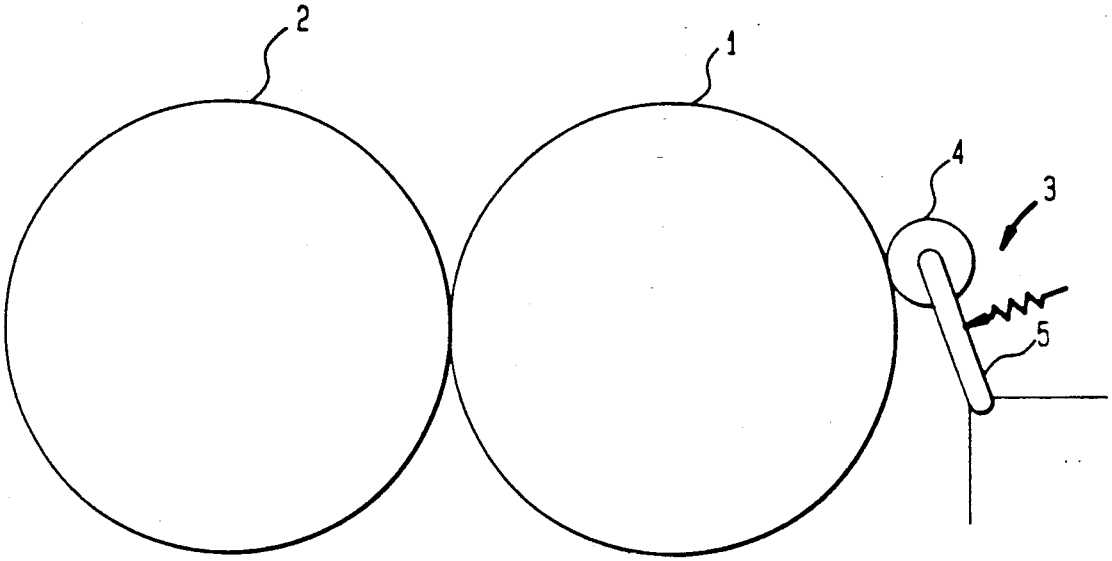
FIG. 1 is a schematic side view of a fixing device in which the invention can be used.

According to FIG. 1, a fusing roller 1 forms a nip with a pressure roller 2 through which receiving sheets having loose toner images on one or both surfaces are fed. Generally, one or both rollers are heated. The combination of heat and pressure fixes the toner image to the receiving sheet. To prevent offset of toner onto fusing roller 1 a small amount of release liquid is applied by a rotatable release liquid applying device 3 which is rotated by fusing roller 1. It is important that the correct amount of release liquid be applied, and that it be applied uniformly to both prevent offset of toner and also excessive or non-uniform oiling of the receiving sheet.

Figure 2:
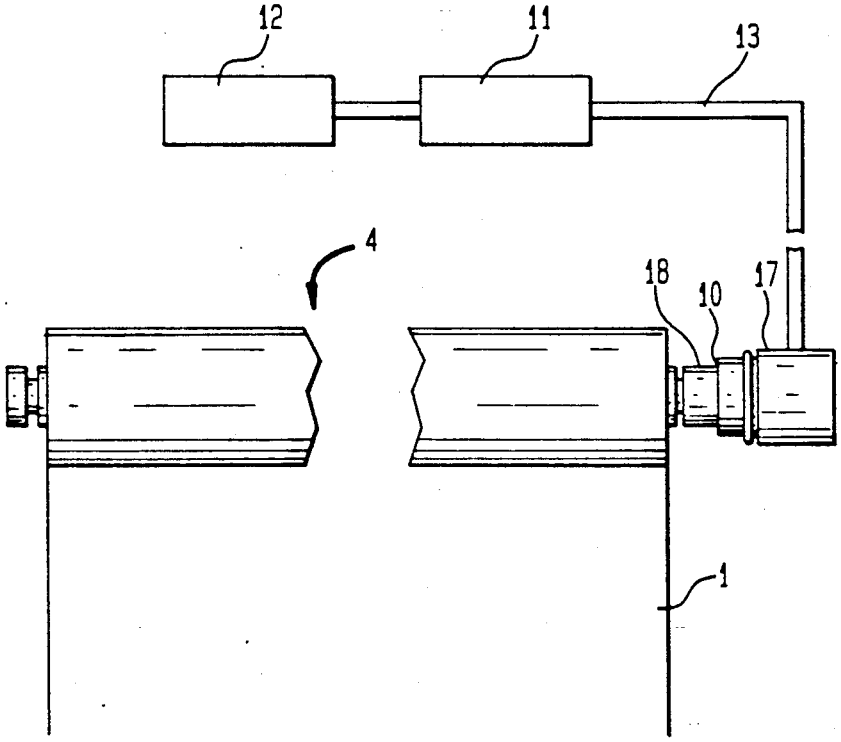
FIG. 2 is a schematic side view of a wick and its receiving structure forming part of a release liquid applying device portion of the fixing device shown in FIG. 1.

The release liquid applying device 3 includes an articulatable rotatable wick 4 held against a surface of fusing roller 1 by a support arm 5. According to FIG. 2, rotatable wick 4 has a suitable end structure which includes a coupling 10 which mates with an apparatus coupling 17 permitting both rotation and feeding of oil under pressure to the center of wick 4. For a complete description of a support and supply structure suitable for wick 4, see U.S. Pat. No. 4,908,670, Ndebi, referred to above, which patent is incorporated by reference herein.

Oil is fed from an oil supply 12 through a conduit 13 by a pump 11 to coupling 10. When a logic and control of the apparatus calls for oil, pump 11 is actuated and oil is fed into wick 4, all as is well known in the art.

Figure 3:
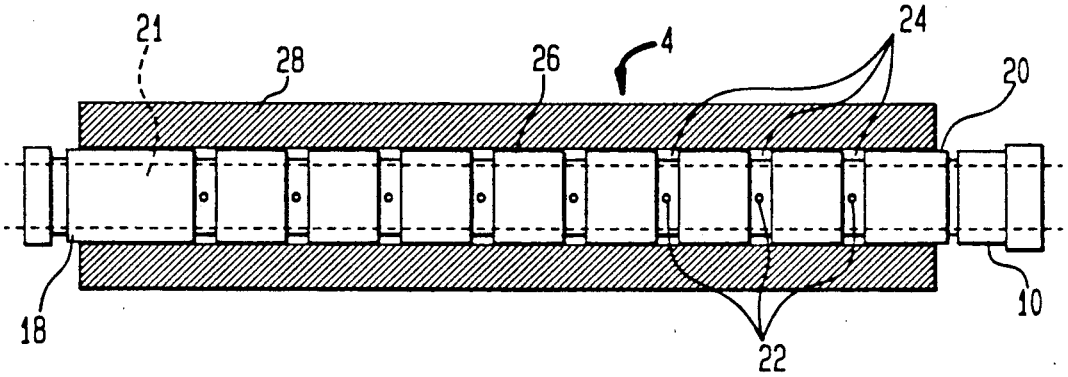
FIG. 3 is a top view partially in section of a wick constructed according to the invention.

According to FIG. 3, wick 4 includes an elongated feed tube 18, shown in unsectioned top view, having a central bore 21 and distribution holes 22. The distribution holes 22 are arranged in a line parallel to the axis of tube 18 so that they can be oriented in a generally upward direction when wick 4 is not rotating to prevent gradual escape of oil under the force of gravity. Feed tube 18 has an exterior surface 20 in which are cut grooves 24 which extend around tube 18. Each of distribution holes 22 opens into one of grooves 24.

A cylindrical porous sheath 26, for example, in the form of a cloth tube, is pulled over the feed tube 18 and covers its exterior surface 20 in the vicinity of the grooves 24. This creates an air gap between the sheath 26 and the bottom of the grooves 24 including the openings to the distribution holes 22.

A wicking fabric 28 is wrapped around the sheath 26 to complete formation of the rotating wick 4. (The wicking material 28 and sheath 26 are shown in section in FIG. 3 for clarity of illustration.) The wicking material 28 can be made of a common fuser wicking substance, for example, wool, nylon. or NOMEX. However, I have found that a PTFE needle felt works best for more applications. The sheath 26 is preferably made of a polyester, nylon or NOMEX cloth and prevents the fibers of the wicking material 28 from clogging the grooves 24 and engaging the openings to the distribution holes 22.

With this structure the grooves help spread the oil around the wick while the combination of the sheath and the grooves form air gap preventing wicking material 28 from wicking oil out of the tube when idle. Without the air gap, wicking from the center of the tube would have a tendency to locally saturate the wicking material 28 and ultimately cause uneven oiling of a receiving sheet. The grooves and sheath thus perform the function previously performed by the porous ceramic material at substantially less cost.

Figure 4:
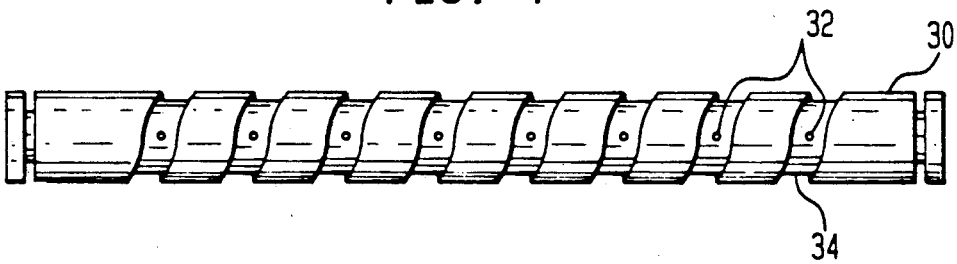
FIG. 4 is a top view of a feed tube for a wick similar to that shown in FIG. 3 but constructed according to an alternative embodiment of the invention.

FIG. 4 demonstrates a further preferred embodiment of the invention in which, instead of a separate groove for each distribution hole, a single helical groove 34 is formed in distribution tube 30. Each hole 32 of a row of distribution holes opens into helical groove 34. The lead of the groove 34 thus is equal to the distance between holes 32. With this structure, if any single hole is clogged, oil from adjacent holes is facilitated by groove 34 to partially supply the area ordinarily supplied by oil from the clogged hole.

Although distribution tubes 18 and 30 can be made out of plastic or carboard, best results appear to be obtained if the tube is made of metal, for example, aluminum or steel.

Coventional commercial feed tubes for rotating wicks have distribution holes generally 0.020 inches in diameter or greater. Elongated apertures or slits formed in the above-mentioned Ndebi patent are laser drilled and are as small as 0.005 inches wide. Although larger diameter holes are usable with higher viscosity release liquids, best results are obtained with the structure shown in FIGS. 3 and 4 if the distribution holes are laser drilled at a thickness less than 0.010 inches, for example, 0.007 inches. With lower viscosity release liquids, which are highly desirable in some applications, relatively even distribution across the length of the tube was obtained with such narrow distribution holes. Best results are obtained if the grooves are wider than they are deep and substantially larger than the diameter of the distribution holes. For example, good results were obtained with distribution holes 0.007 inches in diameter with grooves that were 0.020 to 0.030 inches deep and 0.040 to 0.050 inches wide.

The porousness of the sheath 26 also is not critical. However, good results were obtained with a 5-10 mil cloth polyester tube.

Prior art wicks with ceramic cores utilize the ceramic to supply structural strength and to spread the liquid both axially and circumferentially. Ordinarily, the absence of the ceramic core would cause spots of excessive liquid associated with the distribution holes as well as the aforementioned problem of wicking low viscosity oil from the tube when the device is idle. With the grooves cut in the distribution tube as shown in either FIGS. 3 or 4, but especially FIG. 4, elimination of areas of excessive saturation in the neighborhood of the distribution holes is substantially reduced permitting use of the wick in high quality applications.

As mentioned above, an improvement in useful life was obtained using as the wicking material a PTFE needle felt, at least for the outer layer compared to the conventional NOMEX needle felt presently used for rotating wicks. The PTFE has exceptional release characteristics. When used as the outer layer of rotating wick, small quantities of toner picked up by the fusing roller are less likely to adhesively bond to the wick fibers, staying instead on the fusing roller where they are returned to the paper. This toner is not noticeable on the paper because of the small quantity at any time. However, with a conventional wick, the toner builds up on the wick, restricting oiling and forcing replacement of the wick. The toner also appears to have less effect on oiling even where the PTFE is contaminated by the toner than does the same amount of toner contamination of other wicking materials. This performance of PTFE needle felt in the outer layer is exhibited in conventional rotating wicks using a ceramic core under the PTFE as well as wicks constructed as shown in FIGS. 3 and 4.

The invention has been described in detail with particular reference to a preferred embodiment thereof, but it will be understood that variations and modifications can be effected within the spirit and scope of the invention as described hereinabove and as defined in the appended claims.

I claim:

1. For use in a rotatable release liquid applying device for applying release liquid to a fusing member, a wick comprising:

a feed tube having a plurality of distribution holes through which release liquid can flow under pressure, groove means in the outer surface of said feed tube, said groove means extending around said tube with said distribution holes opening into said groove means, a thin porous sheath around said tube, said sheath covering the grooves means while leaving an air space between each distribution hole and the sheath, and wicking material wrapped around the outside of said sheath.

2. A wick according to claim 1 wherein said groove means includes a plurality of grooves around said outer surface, each of said distributions holes opening into a different one of said grooves.

3. A wick according to claim 1 wherein said groove means includes a single helical groove around the outside surface of said feed tube, all of said distribution holes opening into said helical groove.

4. A wick according to claim 3 wherein said distribution holes are aligned and the lead of said helical groove is equal to the distance between said distribution holes.

5. A wick according to claim 1 wherein said sheath is a thin porous cloth tube.

6. A wick according to claim 5 wherein said cloth is made of a porous synthetic material.

7. A wick according to claim 1 wherein said wicking material is a heat resistant synthetic wicking material.

8. A wick according to claim 1 wherein said wicking material includes at least an outer layer of polytetrafluoroethylene wicking material.

9. A wick according to claim 1 wherein said distribution holes are less than 0.010 inches is diameter.

10. A feed tube for use as a central portion of a wick for a toner fusing device, said feed tube comprising an elongated tube having a central bore and a plurality of distribution holes through said bore and groove means around the outer surface of said tube into which said distribution holes open, said distribution holes being positioned along a line generally parallel to the axis of said tube and said groove means being a single helical groove into which each of said holes opens, said groove having a lead equal to the distance between said distribution holes.

11. A feed tube according to claim 10 wherein said groove means is between 0.0020 and 0.030 inches deep and 0.040 and 0.050 inches wide.

12. A feed tube for use as a central portion of a wick for a toner fusing device, said feed tube comprising an elongated tube having a central bore and a plurality of distribution holes through said bore and groove means around the outer surface of said tube into which said distribution holes open, said groove means being between 0.020 and 0.030 inches deep and 0.040 and 0.050 inches wide.

* * * * *